US010822879B2

(12) United States Patent
Batarseh

(10) Patent No.: US 10,822,879 B2
(45) Date of Patent: Nov. 3, 2020

(54) LASER TOOL THAT COMBINES PURGING MEDIUM AND LASER BEAM

(71) Applicant: Saudi Arabian Oil Company, Dhahran (SA)

(72) Inventor: Sameeh Issa Batarseh, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 132 days.

(21) Appl. No.: 16/056,701

(22) Filed: Aug. 7, 2018

(65) Prior Publication Data

US 2020/0048967 A1 Feb. 13, 2020

(51) Int. Cl.
*E21B 7/15* (2006.01)
*E21B 21/16* (2006.01)

(52) U.S. Cl.
CPC ..... *E21B 7/15* (2013.01); *E21B 21/16* (2013.01)

(58) Field of Classification Search
CPC ..... E21B 7/15; E21B 21/16
See application file for complete search history.

(56) References Cited

U.S. PATENT DOCUMENTS 4,227,582 A * 10/1980 Price ..... E21B 7/15 166/297
6,755,262 B2 6/2004 Parker
8,627,901 B1 1/2014 Underwood et al.
8,755,262 B2 6/2014 Ueki
9,353,612 B2 5/2016 Batarseh
9,932,803 B2 4/2018 Batarseh et al.
2004/0206505 A1* 10/2004 Batarseh ..... E21B 43/11 166/302
2006/0102343 A1 5/2006 Skinner et al.
2010/0044102 A1* 2/2010 Rinzler ..... E21B 7/14 175/15
2010/0044103 A1* 2/2010 Moxley ..... E21B 7/14 175/16
2010/0078414 A1 4/2010 Perry et al.
2012/0074110 A1* 3/2012 Zediker ..... B08B 7/0042 219/121.72

(Continued)

FOREIGN PATENT DOCUMENTS

CN 203081295 U 7/2013
CN 203334954 U 12/2013
WO WO-2016/090229 A1 6/2016

OTHER PUBLICATIONS

International Search Report for PCT/IB2018/057620, 5 pages (dated Apr. 15, 2019).

(Continued)

*Primary Examiner* — D. Andrews
(74) *Attorney, Agent, or Firm* — Choate, Hall & Stewart LLP; Charles E. Lyon; Peter Flynn

(57) ABSTRACT

An example laser tool that operates within a wellbore is configured to combine a purging medium and a laser beam. The laser tool includes an integrator configured to receive the laser beam from a laser head and to combine the laser beam and the purging medium. A conduit is configured to generate a laminar flow from the purging medium and to produce an output that includes the laminar flow and the laser beam. The output is directed by the conduit towards a target within the wellbore. At least part of the laser tool is configured for rotation to cause the output to rotate during application of the output to the target.

20 Claims, 6 Drawing Sheets

(56) References Cited

U.S. PATENT DOCUMENTS

| | | | | |
|---|---|---|---|---|
| 2014/0360778 | A1 | 12/2014 | Batarseh | |
| 2016/0084008 | A1 | 3/2016 | Faircloth et al. | |
| 2020/0048966 | A1* | 2/2020 | Batarseh | E21B 47/00 |

OTHER PUBLICATIONS

Written Opinion for PCT/IB2018/057620, 7 pages (dated Apr. 15, 2019).
International Preliminary Examining Authority Written Opinion for PCT/IB2018/057620, 5 pages (dated Jul. 13, 2020).

* cited by examiner

LASER TOOL THAT COMBINES PURGING MEDIUM AND LASER BEAM

TECHNICAL FIELD

This specification describes examples of laser tools configured to combine a purging medium and a laser beam for output to a target.

BACKGROUND

A laser tool may be used to output a laser beam within a wellbore. The laser beam may be used in a number of applications, such as creating holes in a wall of the wellbore. In an example operation, a laser tool is lowered downhole. The laser tool outputs a laser beam targeting the wall of the wellbore. Heat from the laser beam breaks or sublimates rock or other structures to form the hole in the wellbore.

SUMMARY

An example laser tool that operates within a wellbore is configured to combine a purging medium and a laser beam. The laser tool includes an integrator configured to receive the laser beam from a laser head and to combine the laser beam and the purging medium. A conduit is configured to generate a laminar flow from the purging medium and to produce an output that includes the laminar flow and the laser beam. The output is directed by the conduit towards a target within the wellbore. At least part of the laser tool is configured for rotation to cause the output to rotate during application of the output to the target. The laser tool may include one or more of the following features, either alone or in combination.

The conduit may be attached to the laser head. The laser head may be rotatable to cause the conduit to rotate. Rotation of the conduit may produce a pattern of impact of the laser beam on the target that is a spiral in shape. The laser tool may be configured for rotation to produce the pattern of impact by starting at a point and spiraling outward. The laser tool may be configured for rotation to produce the pattern of impact by starting at a point and spiraling inward.

The purging medium may include a gas or a liquid. The purging medium may include halocarbon. The integrator may be configured to produce a turbulent flow of the purging medium. The conduit may be configured to convert the turbulent flow to the laminar flow. The laminar flow may surround the laser beam within the conduit.

The optical power of the laser beam may be within a range of 0.2 kilowatts (kW) to 100 kW. For example, the optical power of the laser beam may be below 1.0 kW.

The laser tool may include a connector to connect the laser tool to a coiled tubing string. The coiled tubing string may be used for moving the laser tool through the wellbore and within a hole created in a formation through which the wellbore extends.

A camera may be disposed on the conduit to capture images or video during operation of the laser tool. An acoustic sensor may be disposed on the conduit to capture sound during operation of the laser tool.

An example method is disclosed for operating a laser tool configured to combine a purging medium and a laser beam. The method includes combining the laser beam and the purging medium in a turbulent flow and generating a laminar flow from the turbulent flow. The laser beam is contained within the laminar flow. The laser tool is rotated while outputting the laser beam and the laminar flow from the laser tool towards a target within a wellbore. The method may include one or more of the following features, either alone or in combination.

Rotating the laser beam may include initially rotating the laser tool and increasing a diameter of rotation for subsequent rotations of the laser tool until a hole is formed through at least part of the target.

After the hole is formed, the laser tool may be moved towards or into the hole. The laser tool may be rotated following movement such that the laser beam and the laminar flow from the laser tool are output towards the hole. Rotating the laser tool following movement may include initially rotating the laser tool and decreasing a diameter of rotation for subsequent rotations of the laser tool until the hole is extended.

After the hole is extended, the laser tool may be moved towards or into the hole. The laser tool may be rotated following moving the laser tool towards or into the hole such that the laser beam and the laminar flow from the laser tool are output towards the hole. Rotating the laser tool following moving the laser tool into the hole may include initially rotating the laser tool and increasing a diameter of rotation for subsequent rotations of the laser tool until the hole is further extended through the target.

The laser tool may be moved towards the hole using a coiled tubing string. Rotation of the laser tool may produce a pattern of impact on the target that is a spiral in shape. A combination of the purging medium and rotating the laser tool may cause debris to be expelled from the target away from a path of the laser beam.

Any two or more of the features described in this specification, including in this summary section, may be combined to form implementations not specifically described in this specification.

At least part of the systems and processes described in this specification may be controlled by executing, on one or more processing devices, instructions that are stored on one or more non-transitory machine-readable storage media. Examples of non-transitory machine-readable storage media include but are not limited to read-only memory, an optical disk drive, memory disk drive, and random access memory. At least part of the systems and processes described in this specification may be controlled using a computing system comprised of one or more processing devices and memory storing instructions that are executable by the one or more processing devices to perform various control operations.

The details of one or more implementations are set forth in the accompanying drawings and the description. Other features and advantages will be apparent from the description the drawings, and the claims.

DESCRIPTION OF THE DRAWINGS

Like reference numerals in the figures indicate like elements.

DETAILED DESCRIPTION

Figure 1:
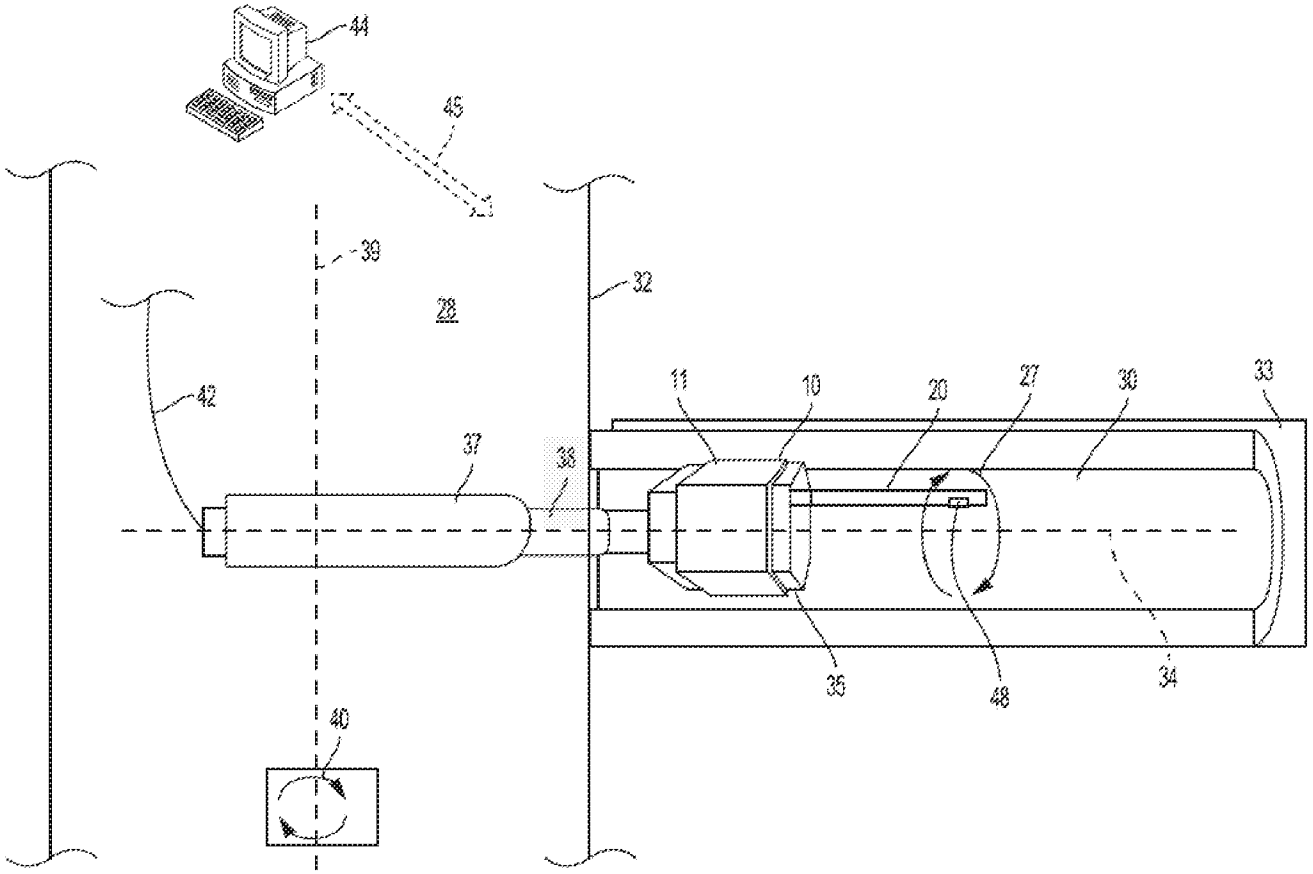
FIG. 1 is a block diagram of a system, including a side view of components an example laser tool downhole in a wellbore.

This specification describes examples of laser tools for targeting structures located downhole, such as rock formations, casing, and debris. An implementation of the laser tool connects to a laser head configured to output a laser beam. The laser beam may be provided by a laser generator that is located downhole or at the surface. An integrator is configured to combine the laser beam and a purging medium. The purging medium may be a liquid or a gas that is output with force from the laser tool in order to disperse debris or other materials cut loose by impact of the laser beam. The integrator combines the laser beam and the purging medium in a turbulent flow. An example turbulent flow includes a flow pattern having random changes in pressure and flow velocity. A conduit—called a laminar flow device—is configured to receive the laser beam and the turbulent flow and to generate a laminar flow based on the turbulent flow. An example laminar flow includes a flow that occurs in smooth paths or layers that are relatively consistent in terms of pressure and flow velocity. The conduit is configured to pass the combined laser beam and the purging medium in the laminar flow and to output that combination towards a target within the wellbore. The combined laser beam and purging medium are coaxial in that the laser beam is contained within the purging medium. In some implementations, the laser beam is surrounded completely by the purging medium within the conduit.

At least part of the laser tool is configured to rotate and thereby cause its output to rotate during application to a target. For example, the entire laser tool may rotate. For example, the conduit, the laser head, or both the conduit and the laser head may rotate while the remainder of the laser tool does not rotate. The rotation may produce a pattern of impact on the target that is a spiral in shape. In an example operation, the diameter of rotation increases for each subsequent rotation of the laser tool until a hole is formed through at least part of the target. Then, after the hole is formed, the laser tool moves towards the hole. Following that movement, the laser tool rotates such that the laser beam and the laminar flow are output towards the hole. At this time, rotating includes decreasing a diameter of rotation for subsequent rotations of the laser tool until the hole is extended further through the target. After the hole is extended, the laser tool is moved further into the hole. The laser tool then rotates such that a diameter of rotation for subsequent rotations of the laser tool increases until the hole is further extended through the target. Any or all of the preceding operations may be repeated until a desired depth of the hole is achieved.

A control system is configured to control movement of at least part of the laser tool to cause the laser beam to move and to rotate within the wellbore. For example, the control system may include a computing system and a coiled tubing unit or a wireline. The laser tool may be moved downhole via the coiled tubing unit or wireline. The movement may be computer-controlled or may be controlled manually. Movement of the laser tool downhole, as described subsequently, may be controlled by sending commands from the computing system to the laser tool.

FIG. 1 shows example components of a laser tool 10. Laser tool 10 includes a laser head 11 configured to output a laser beam. The laser beam may be generated by a laser generator ("generator"), which is not show in FIG. 1. An example generator is a direct diode laser. Direct diode lasers include laser systems that use the output of laser diodes directly in an application. This is in contrast to other types of lasers in which the output of laser diodes is used to pump another laser to generate an output. Examples of direct diode lasers include systems that generate straight-line beam shapes and systems that generate circular beam shapes. A straight-line beam shape includes lasers that travel directly from one point to another. A straight-line beam shape also includes lasers having a diameter that stays the same or that changes during travel. A circular beam shape is generated by rotation of a straight-line beam about an axis to produce a circular pattern at a point where the laser beam impacts its target. Example lasers include ytterbium lasers, erbium lasers, neodymium lasers, dysprosium lasers, praseodymium lasers, and thulium lasers.

The generator may be located at the surface of the well, for example, at the wellhead. In this case, the laser beam may be transported downhole to the laser tool using an optical transmission medium such as fiber optic cable. In some implementations, all or part of the generator may be located within the wellbore. In cases where the optical power of the laser beam is above 1.0 kilowatts (kW), there may be advantages to using generators that are located downhole. For example, optical power loss may be reduced by locating the generator downhole.

In some implementations, the laser beam has an optical power that is within a range of 0.2 kW to 100 kW. In some implementations, the laser beam has an optical power of 1 kW or less and has an intensity of 5 $kW/cm^2$ (kilowatts per centimeter squared) or greater. In some implementations, the laser beam has a diameter that is within a range of 0.25 inches (6.35 millimeters (mm)) to 2.0 inches (50.8 mm).

Figure 2:
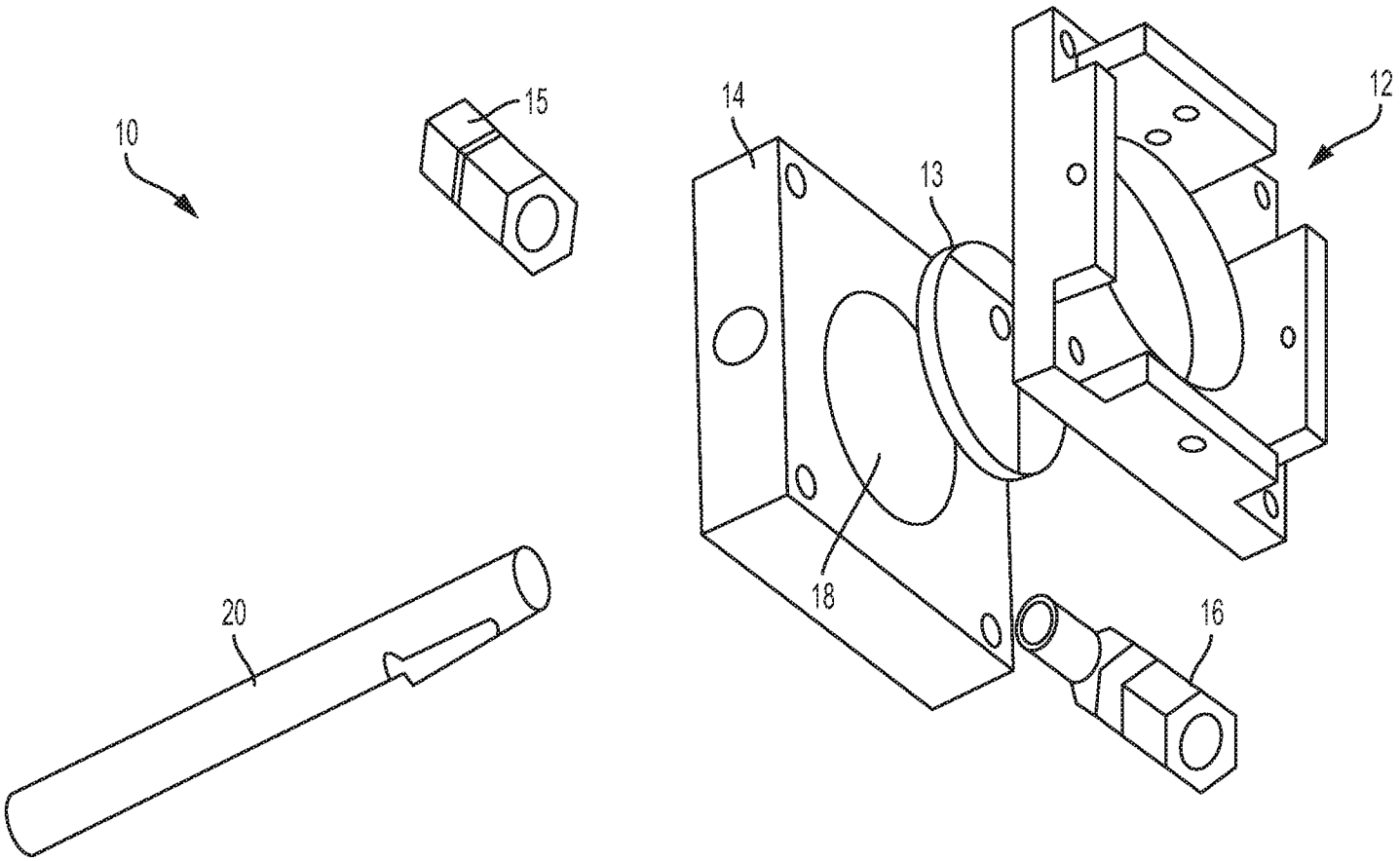
FIG. 2 is an exploded view of components of the example laser tool.

Referring also to FIG. 2, laser tool 10 includes an input mount 12 for the laser head. The input mount 12 receives and holds the laser head. Cover glass 13 may include a lens or glass that passes the laser beam from the laser head to integrator 14. In some implementations, the cover glass may not change the size or the shape of the laser beam. In some implementations, the cover glass may change the size or the shape of the laser beam. For example, the cover glass may collimate the laser beam. Collimation includes causing the laser beam to maintain a substantially constant cross-sectional area. In some implementations, collimation may include reducing the cross-sectional area of the laser beam. In some implementations, the cover glass may focus or disperse the laser beam. In any case, the resulting laser beam should have a sufficient size and shape to fit within conduit 20, namely the laminar flow device.

Integrator 14 is configured—for example, structured—to receive the laser beam and to combine the received laser beam with one or more purging media. The purging media may be or include gas, liquid, or both gas and liquid. The purging media may be or include different types of gas, different types of liquid, or different types of gas and liquid. The choice of purging media to use, such as gas or liquid, can be based on the composition of the target, such as rock in a formation, and the pressure of a reservoir associated with the formation. In some implementations, the purging media can be or include a non-reactive, non-damaging gas such as nitrogen or a liquid such as halocarbon. A halocarbon includes a compound, such as a chlorofluorocarbon, that includes carbon combined with one or more halogens.

Examples of halocarbon include halocarbon-oil having viscosities in a range from halocarbon-oil 0.8 centipoise (cP) to halocarbon-oil 1000 cP at 100 degrees (°) Fahrenheit (37.8° Celsius). A gas purging medium may be appropriate when pressure in the wellbore is small, for example, less than 50000 kilopascals, less than 25000 kilopascals, less than 10000 kilopascals, less than 5000 kilopascals, less than 2500 kilopascals, less than 1000 kilopascals, or less than 500 kilopascals.

A purging medium is provided to integrator 14 via purge inputs 15 and 16. Integrator 14 includes a cavity 18 to receive the purging media from the inputs. Within this cavity, the purging medium is a turbulent flow. The integrator combines the laser beam from the laser head with the purging medium in the turbulent flow to produce an output. The integrator outputs the combined the laser beam and purging medium in the turbulent flow to conduit 20.

Figure 3:
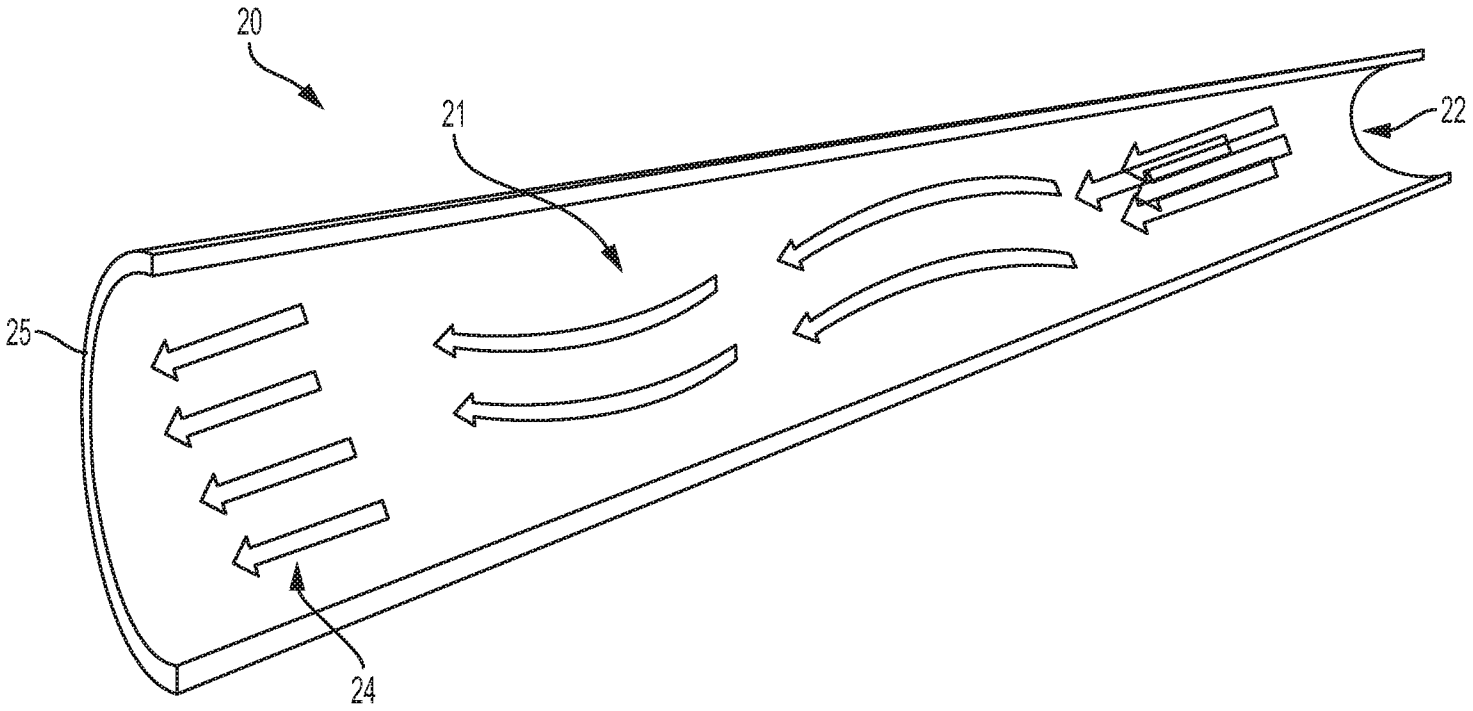
FIG. 3 is a perspective, cut-away view of an example laminar flow device that depicts conversion of a turbulent flow to a laminar flow.

Conduit 20 is configured to receive the combined laser beam and purging medium in the turbulent flow. The tubular shape of the conduit and the length of the conduit causes the turbulent flow to change to the laminar flow. Different lengths may be required to convert turbulent flows having different pressures to laminar flows. For example, for a flow having a greater pressure, a longer conduit may be required to convert the flow from a turbulent flow to a laminar flow. In an example, implementation, conduit 20 is within a range of 0.25 inches (6.35 mm) to 2.0 inches (50.8 mm) in diameter and 6 inches (15.24 centimeters (cm)) to 40 inches (100 cm) in length. FIG. 3 shows conceptually that conduit 20 converts a turbulent flow 21 entering at inlet 22 into a laminar flow 24 at its output 25. The turbulent and laminar flows are depicted conceptually using arrows. The laminar flow is coaxial with the laser beam in the sense that the laser beam is embedded in and output with the purging medium. For example, the purging medium may completely surround the laser beam during passage of both through conduit 20. In some implementations, the laminar flow is constant over time. In some implementations, the laminar flow varies over time.

At least part of the laser tool is configured to rotate within the wellbore in order to cause the conduit to rotate. As a result, the laser beam and the purging medium in the laminar flow also rotate within the wellbore. In an example, rotation is about an axis that intersects a hole to be formed by the laser tool. For example, as shown in FIG. 1, laser tool 10 is inside wellbore 28 and is controlled to form a hole 30 within wall 32 of the wellbore 28. In this example, wellbore 28 passes through a hydrocarbon-bearing rock formation 33 that may include various materials, such as limestone, shale, or sandstone. The hole to be formed is intersected by axis 34. Laser tool 10 is configured to rotate so that conduit 20 rotates around this axis. An example rotation is depicted by arrows 27. For example, as shown in FIG. 1, conduit 20 may be mounted to a rotational device 35 mounted to the laser head. The rotational device may rotate to cause conduit 20 to rotate about axis 34 in order to create the hole, as described subsequently. In some implementations, the entire laser tool may rotate within the wellbore to cause the conduit to rotate about the axis. The coiled tubing unit may be controlled to rotate the laser tool about the axis. For example, coiled tubing string 37 may be controlled to implement the rotation. In some implementations, the laser head may rotate within the wellbore to cause the conduit to rotate about the axis.

The control system is configured to control movement, including rotation, of the laser tool within the wellbore. In addition to the computing system and coiled tubing unit or wireline described previously, the control system can include, for example, a hydraulic system, an electrical system, or a motor-operated system to move the laser tool. For example, a motor or other mechanical mechanism may be operated to rotate the entire laser tool or the laser head only as described in the preceding paragraph. The motor or other mechanical mechanism may be controlled by the computing system to initiate, to continue, and to end the rotation.

The laser tool may be moved uphole and downhole by the coiled tubing unit or a wireline. In cases where a coiled tubing unit is used, a reel that is part of the coiled tubing unit assembly may move the laser tool along longitudinal axis 39 of the wellbore vertically in the case of a vertical well. The laser tool may be suspended within the wellbore through connection to a bottom hole assembly. Lateral movement of the laser tool within the wellbore may be implemented via the coiled tubing string. A connector 38 may connect the laser tool, the laser head, or both to the coiled tubing string. The lateral movement includes, for example, movement into and out of holes formed by the laser tool, as described with respect to FIGS. 4, 5, and 6.

The coiled tubing unit may also be controlled to rotate the laser tool within the wellbore. For example, the rotation may be around longitudinal axis 39 of wellbore 28. An example rotation is depicted by arrows 40. The rotation may be used to position the laser tool so that the output of the laser tool is directed towards its target. This rotation may be implemented by rotating the coiled tubing string.

Laser tool 10 also includes cabling 42 that runs uphole to the surface of the wellbore. In an example, the cabling may include power cables to run electrical power to the laser tool. The electrical power may be generated uphole in some implementations. In an example, the cabling may include communication cables such as Ethernet or fiber optics to carry commands to the laser tool. The commands may be generated by a computing system 44 that is located at the surface. The commands may control operation of the laser tool. For example, the commands may include commands to turn the laser generator on or off, to adjust an intensity of the laser beam, or to control movement, including rotation, of the laser beam within the wellbore. In some implementations, all or some of these commands may be conveyed wirelessly. Dashed arrow 45 represents communications between the laser tool and the computing system. Casing may protect all or part of the cabling from downhole conditions.

As noted, the computing system may be part of the control system for the laser tool. The computing system may be configured—for example, programmed—to control positioning, operation, and rotation of the laser tool. Examples of computing systems that may be used are described in this specification. Signals may be exchanged between the computing system and the control system via wired or wireless connections. The control system may include on-board circuitry or an on-board computing system to implement control over the positioning and operation of the laser tool. The on-board circuitry or on-board computing system are "on-board" in the sense that they are located on the laser tool itself or downhole with the laser tool, rather than at the surface. The on-board computing system may communicate with the computing system on the surface to control operation and movement of the laser tool.

The example laser tool may also include one or more sensors 48 to monitor environmental conditions in the wellbore and to output signals indicative of the environmental conditions. Examples of the sensors may include temperature sensors to measure temperature downhole, pressure sensors to measure pressure downhole, and vibration sensors to measure vibrations levels downhole. The computing system may receive signals from one or more of these sensors. The signals received from the sensors may indicate that there are problems inside the wellbore or that there are problems with the laser tool. A drilling engineer may take corrective action based on these signals. For example, if a temperature or pressure downhole is such that equipment such as the laser tool may be damaged, that equipment may be withdrawn from the wellbore. Other sensors may also be included in the laser tool.

For example, in some implementations, the laser tool may include acoustic sensors for obtaining acoustic data, a camera for capturing images or video, or an acoustic camera configured both to obtain acoustic data and to capture images or video. For example, the acoustic sensors may be located at or near the output of conduit 20. For example, the camera may be located on or near the laser head or at or near the output of the conduit 20. For example, the acoustic camera may be located on or near the laser head or at or near the output of the conduit 20. Transmission media such as fiber optics or Ethernet may run the length of conduit 20 and connect to cabling that leads to the surface. The transmission media may be located on the exterior of conduit 20 or on the interior or conduit 20. Data obtained from the acoustic sensors, the camera, or the acoustic camera may be sent to the surface computing system via the transmission media and the cabling. At that computing system, the data may be processed to view the operations down-hole in real-time. In this regard, real-time may not mean that two actions are simultaneous, but rather may include actions that occur on a continuous basis or track each other in time, taking into account delays associated with processing, data transmission, and hardware. At the surface computing system, the data may be processed to determine downhole conditions. For example, if an image of a hole being drilled shows that the hole is not within a target location, the computing system may control the laser tool to change the location of the hole. For example, if the acoustic data indicates the presence of excess debris or unexpected rock in the formation, operation of the laser tool may be changed to account for these conditions.

In some implementations, data obtained from the acoustic sensors, the camera, or the acoustic camera may be sent via the transmission media to a computing system that is on-board the laser tool. The on-board computing system may perform all or some of the operations described in the preceding paragraph. In some implementations, the on-board computing system may cooperate with a surface-based computing system to control operation of the laser tool based on sensor readings. For example, the on-board computing system may be configured—for example, programmed—to control operation when the sensor readings are within a prescribed range. That is, automatic controls may be implemented, rather than requiring input from a drilling engineer. If the sensor readings are outside the prescribed range, the surface-based computing system may take over control of the laser tool.

Figure 4:
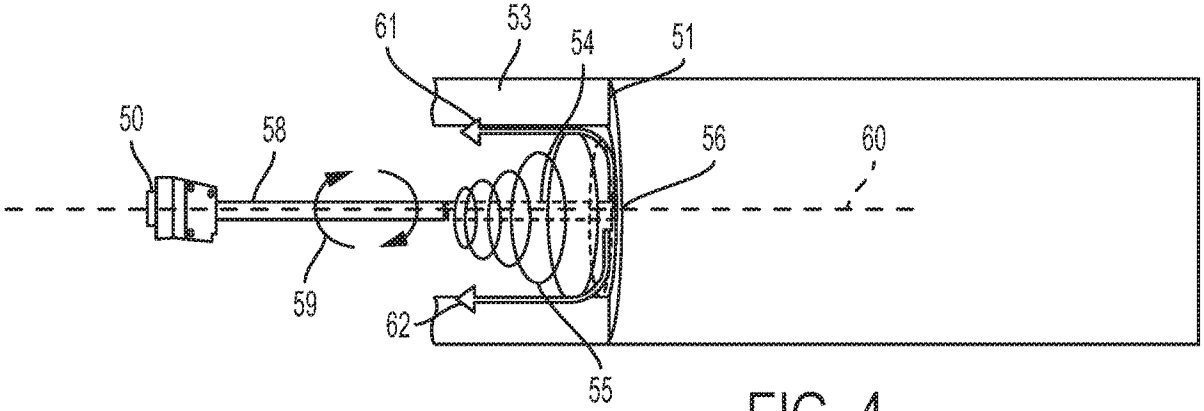
FIG. 4 is a side view of operation of an example laser tool during formation of a hole in a wellbore.
Figure 5:
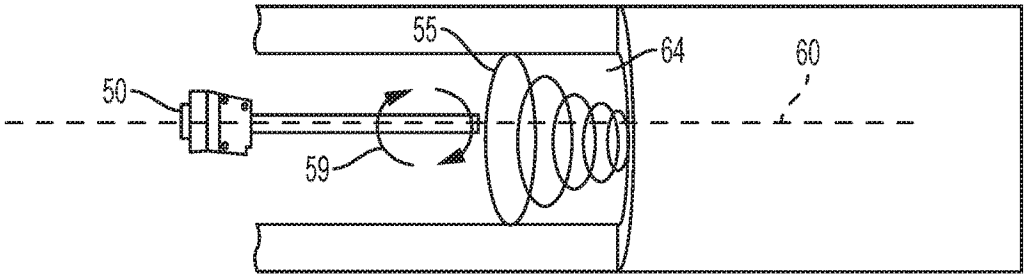
FIG. 5 is a side view of operation of the example laser tool at a time after a time shown in FIG. 4.
Figure 6:
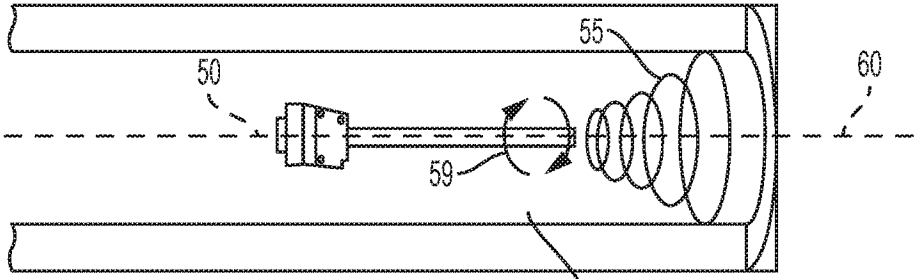
FIG. 6 is a side view of operation of the example laser tool at a time after a time shown in FIG. 5.
Figure 7:
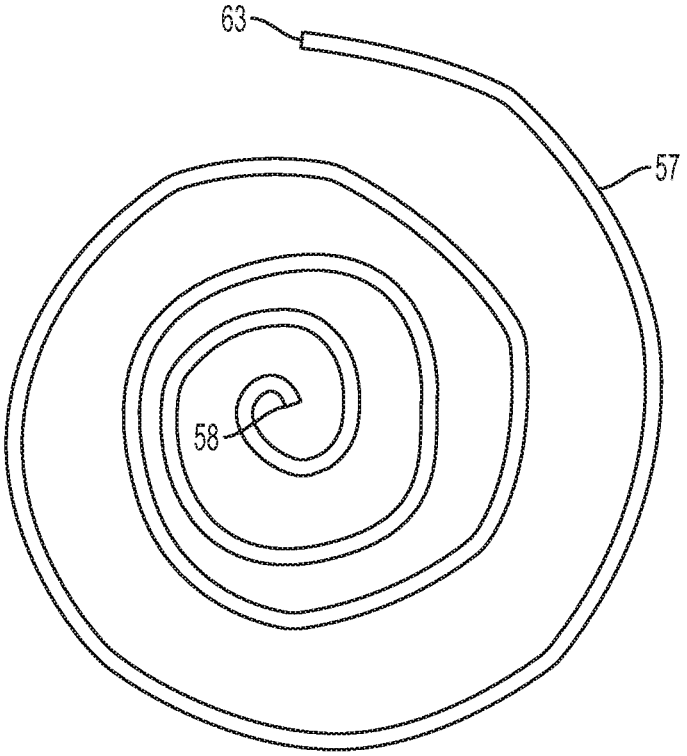
FIG. 7 shows an example spiral impact pattern produced by the laser tool.

FIGS. 4, 5, and 6 show an example operation of a laser tool 50, which may be the same as, or have the same features as, laser tool 10 of FIG. 1. In this example, laser tool 50 is controlled to drill a lateral hole in a wall 51 of wellbore 53. As shown in the figures, all or part of the laser tool is rotated while outputting a laser beam 54 and the laminar flow towards the wall of the wellbore—the target in this example. Rotation is depicted conceptually by circles 55 in each figure. The rotation produces a pattern of impact on the wall that is a spiral in shape. An example pattern of impact 57 that is spiral is shown in FIG. 7. The pattern of impact may be formed by rotating the laser tool at an increasing diameter, as shown in FIGS. 4 and 6. In this example, an increasing diameter includes the spiral starting from point 58 in FIG. 7 and spiraling outward to point 63. The pattern of impact may be formed by rotating the laser tool at a decreasing diameter, as shown in FIG. 5. In this example, a decreasing diameter includes the spiral starting from point 63 and spiraling inward to point 58. Other patterns of rotation may be used. For example, a pattern may include concentric circles.

Figure 8:
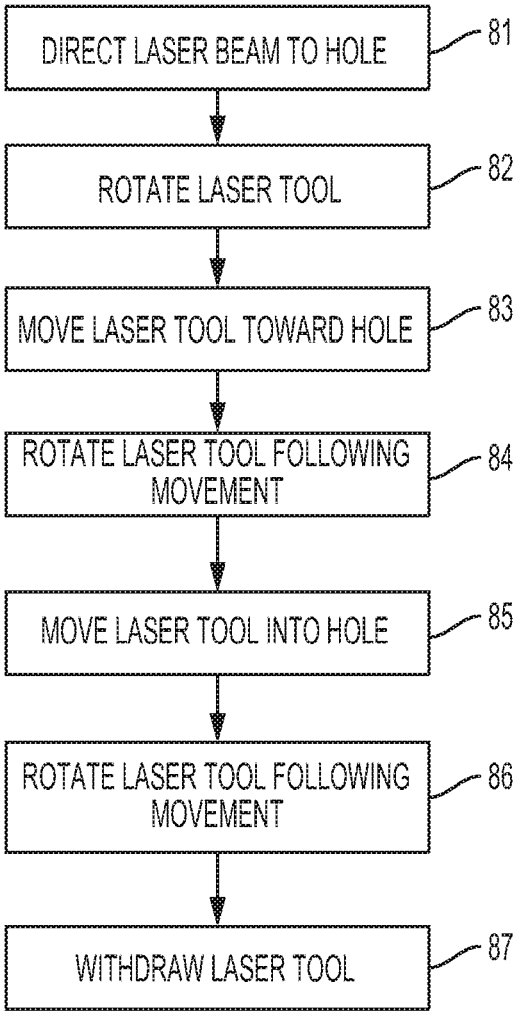
FIG. 8 is a flowchart showing an example operation of the laser tool.

As explained, the laser tool operates by combining a laser beam and a purging medium in a turbulent flow, generating a laminar flow from the turbulent flow, and rotating the laser tool while outputting the laser beam and the laminar flow from the laser tool towards a target within a wellbore. In this example, the target is an unpenetrated rock formation wall within the wellbore. Referring to FIG. 8, the laser beam may initially be directed (81) to or near a center of the hole to be formed. The laser beam removes material—for example, through sublimation, spallation, or both—from the wall of the wellbore to form the hole. Sublimation includes changing from a solid phase directly into a gaseous phase without first changing into a liquid phase.

Referring to FIG. 4, laser tool 50 is positioned to form a hole centered at point 56 in the wall of the wellbore. For example, the control system may cause the coiled tubing unit to move the laser tool to a location near to where the hole is to be formed. For example, the laser tool may be moved so that conduit 58 aligns to the center of the hole. There, conduit 58 is rotated relative to the wall of wellbore 53 while the laser tool outputs the laser beam and the laminar flow. Rotation is depicted conceptually in FIGS. 4, 5, and 6 by arrows 59. The laser beam forms the hole through spallation, sublimation, or a combination of spallation and sublimation. In this example, during its initial application to the wellbore, the laser tool rotates (82) so that its output, namely the laser beam and the laminar flow, is provided in an expanding spiral pattern. For example, diameters for subsequent rotations of the laser tool increase until an initial part of a hole is formed in the wall of the wellbore. This is depicted conceptually by circles 55 becoming larger from left to right. As explained the entire laser tool may be rotated or only part of the laser tool, such as the laser head and conduit, may be rotated during operation. As noted, rotation is about an axis 60 that intersects the center of the hole or near the center of the hole to be formed by the laser tool.

Because the laser beam and the laminar flow are co-axial, rotation of the laser tool also causes rotation of the laminar flow that tracks rotation of the laser beam. Purging thus occurs at the same time as ablation by the laser beam. The combination of the spiral rotation and the laminar flow of the purging media causes debris broken-off from the wellbore wall to be expelled out of the path of the laser beam. For example, as shown in FIG. 4, the rotating laminar flow directs debris in an outward direction, away from the laser beam. In the example of FIG. 4, during, debris exits along the direction of arrows 61 and 62. As a result of this operation, there is less chance for the laser beam to be absorbed by debris. Thus, the full energy of the laser beam can be delivered to the wall of the wellbore to form the hole.

As show in FIG. 5, after part of the hole 64 is formed, the laser tool is moved (83) towards the hole or into the hole in some cases. Movement may be lateral along axis 60, as shown in FIGS. 4 and 5. In some cases, this movement is implemented using the coiled tubing unit or a wireline and may be controlled manually, by a computing system at the surface or by an on-board computing system. The laser tool is again rotated (84) following this movement such that the laser beam and the laminar flow from the laser tool are output to extend the hole. In this example, the initial rotation of the laser tool starts at the outside edge of a spiral pattern (where the prior rotation of FIG. 4 ended) and spirals inward towards or to the center of the hole, as shown in FIG. 5. In other words, the diameter of rotation is decreased for subsequent rotations of the laser tool until the hole is extended through the wall of the wellbore. This is depicted conceptually in FIG. 5 by circles 55 becoming smaller from left to right. Rotation of the laser tool or components of the laser tool may be implemented as described previously. As described with respect to FIG. 4, the combination of the spiral rotation and the laminar flow of the purging media causes debris broken-off from the wellbore wall to be expelled from the hole out of the path of the laser beam.

As show in FIG. 6, after hole 64 is extended, the laser tool is moved (85) towards the hole or into the hole as in this example. Movement may be along axis 60, as shown in FIG. 6. In some cases, this movement is implemented using the coiled tubing unit or a wireline and may be controlled manually, by a computing system at the surface, or by an on-board computing system. The laser tool is again rotated (86) following this movement such that the laser beam and the laminar flow from the laser tool are output towards the hole. In this example, the rotation of the laser tool starts at the center of a spiral pattern such as the center of the hole (where the prior rotation of FIG. 5 ended) and spirals outward towards or to the edge of the hole. In other words, the diameter of rotation is increased for subsequent rotations of the laser tool until the hole is extended through the wall of the wellbore. This is depicted conceptually in FIG. 6 by circles 55 becoming larger from left to right. Rotation of the laser tool or components of the laser tool may be implemented as described previously. As described with respect to FIG. 4, the combination of the spiral rotation and the laminar flow of the purging media causes debris broken-off from the wellbore wall to be expelled from the hole out of the path of the laser beam. Purging media from the laminar flow may carry debris into the wellbore and to the surface in the examples of FIGS. 4, 5, and 6.

Operations like those shown in FIGS. 4, 5, and 6 may be repeated until hole 64 reaches a desired depth. After that depth is reached, the laser tool may be withdrawn (87) from the hole and used for other applications returned to the surface.

The operations shown in FIGS. 4, 5, and 6 need not occur in the sequence shown. For example, hole formation may start with a decreasing spiral pattern, followed by an increasing spiral pattern, and so forth. In some cases, a hole may be formed using a single rotational sequence without lateral movement towards or into the hole. In some operations, the laser tool may be moved into the hole later than shown in FIGS. 4 to 6—for example, in a fourth movement (not shown). In some operations, the laser tool may be moved into the hole sooner than shown in FIGS. 4 to 6—for example, in the second movement. The amount of movement of the laser tool towards or into the hole may depend on various factors, such as the depth of the hole to be drilled, the hardness of the target, and the intensity of the laser beam used.

The speed of rotation, optical power of the laser beam, duration of use, distance from the purging output to the target, and the purging flow rate and type may be determined based on a composition of the rock or other target to be ablated by the laser beam. For example, if a rock sample has more than 55% quartz ($SiO_2$), then spallation can occur by breaking cementation and discharging resulting grains. This may occur using laser beams having an optical power within a range of 800 Watts (W) to 1200 W. By contrast, a carbonate formation may require greater optical power, such as 5000 W, to dissociate the calcium carbonate and cause spallation.

In an example implementation, the laser tool is mounted on a ytterbium laser head to form a hole through sandstone. The energy delivered to the sandstone is 1200 W and the laser beam is a collimated beam having a 0.25 inch (6.35 mm) diameter. In this example, air is used as the purging medium. The laser tool is moved in a spiral pattern to form a circular shape hole. The purging medium expels debris and cuttings as described previously to create a circular hole through the sandstone.

The example laser tool described in this specification may be operated in wells that are vertical or in wells that are, in whole or part, non-vertical. For example, the laser tools may be operated in a vertical well, a deviated well, a horizontal well, or a partially horizontal well, where horizontal is measured relative to the Earth's surface.

The example laser tool may operate downhole to stimulate a wellbore. For example, the laser tool may operate downhole to create a fluid flow path through a rock formation. The fluid flow path may be created by controlling the laser tool to direct a laser beam towards the rock formation. In an example, the laser beam has an energy density that is great enough to cause at least some of the rock in the rock formation to sublimate or to break to form a hole. Fluids, such as water, may be introduced into the hole to fracture the rock formation and thereby promote the flow of production fluid, such as oil, from the rock formation into the wellbore.

The example laser tool may operate downhole to create holes in a casing in the wellbore to repair cementing defects. In an example, a wellbore includes a casing that is cemented in place to reinforce the wellbore against a rock formation. During cementing, cement slurry is injected between the casing and the rock formation. Defects may occur in the cement layer, which may require remedial cementing. Remedial cementing may involve squeezing additional cement slurry into the space between the casing and the rock formation. The example laser tool may be used to direct a laser beam to the casing to create one or more holes in the casing on or near a cementing defect. The holes may provide access for a cementing tool to squeeze cement slurry through the hole into the defect.

The example laser tool may operate downhole to create holes in a casing in the wellbore to provide access for a wellbore drilling tool. In an example, an existing single wellbore is converted to a multilateral well. A multilateral well is a single well having one or more wellbore branches extending from a main borehole. In order to drill a lateral well into a rock formation from an existing wellbore, a hole is created in the casing of the existing wellbore. The example laser tool may be used to create a hole in the casing at a desired location for a wellbore branching point. The hole may provide access for drilling equipment to drill the lateral wellbore.

The example laser tool may operate downhole to create holes in a casing in the wellbore to provide sand control. During operation of a well, sand or other particles may enter the wellbore causing a reduction in production rates or damage to downhole equipment. The example laser tool may be used to create a sand screen in the casing. For example, the laser tool may be used to perforate a casing by creating a number of holes in the casing that are small enough to prevent or to reduce entry of sand or other particles into the wellbore while maintaining flow of production fluid into the wellbore.

The example laser tool may operate downhole to re-open a blocked fluid flow path. In this regard, production fluid flows from tunnels or cracks in the rock formation into the wellbore through holes in the wellbore casing and cement layer. These production fluid flow paths may become clogged with debris contained in the production fluid. The example laser tool may be used to generate a laser beam that has an energy density that is great enough to liquefy or to sublimate the debris in the flow paths, allowing for removal of the debris together with production fluid. For example, a laser tool may be used to liquefy or to sublimate sand or other particles that may have become packed tightly around a sand screen in the casing, thereby re-opening a production fluid flow path into the wellbore.

The example laser tool may operate downhole to weld a wellbore casing or other component of a wellbore. During operation, one or more metal components of a wellbore may become rusted, scaled, corroded, eroded, or otherwise defective. Such defects may be repaired using welding techniques. The laser tools may be used to generate a laser beam that has an energy density that is great enough to liquefy metal or other material to create a weld. In some implementations, material of a wellbore component, such as a casing material, may be melted using the laser tool. Resulting molten material may flow over or into a defect, for example due to gravity, thus covering or repairing the defect upon cooling and hardening. In some implementations, the laser tool may be used in combination with a tool that provides filler material to the defect. The laser tool may be used to melt an amount of filler material positioned on or near a defect. The molten filler material may flow over or into a defect, thus covering or repairing the defect upon cooling and hardening.

The example laser tool may operate downhole to heat solid or semi-solid deposits in a wellbore. In producing wells, solid or semi-solid substances may deposit on wellbore walls or on downhole equipment causing reduced flow or blockages in the wellbore or production equipment. Deposits may be or include condensates (solidified hydrocarbons), asphaltene (a solid or semi-solid substance comprised primarily of carbon, hydrogen, nitrogen, oxygen, and sulfur), tar, hydrates (hydrocarbon molecules trapped in ice), waxes, scale (precipitate caused by chemical reactions, for example calcium carbonate scale), or sand. The example laser tool may be used to generate a laser beam that has an energy density that is great enough to melt or to reduce the viscosity of deposits. The liquefied deposits can be removed together with production fluid or other fluid present in the wellbore.

At least part of the example laser tool and its various modifications may be controlled by a computer program product, such as a computer program tangibly embodied in one or more information formation carriers. Information carriers include one or more tangible machine-readable storage media. The computer program product may be executed by a data processing apparatus. A data processing apparatus can be a programmable processor, a computer, or multiple computers.

A computer program may be written in any form of programming language, including compiled or interpreted languages. It may be deployed in any form, including as a stand-alone program or as a module, component, subroutine, or other unit suitable for use in a computing environment. A computer program may be deployed to be executed on one computer or on multiple computers. The one computer or multiple computers can be at one site or distributed across multiple sites and interconnected by a network.

Actions associated with implementing the systems may be performed by one or more programmable processors executing one or more computer programs. All or part of the systems may be implemented as special purpose logic circuitry, for example, an field programmable gate array (FPGA) or an ASIC application-specific integrated circuit (ASIC), or both.

Processors suitable for the execution of a computer program include, by way of example, both general and special purpose microprocessors, and any one or more processors of any kind of digital computer. Generally, a processor will receive instructions and data from a read-only storage area or a random access storage area or both. Elements of a computer include one or more processors for executing instructions and one or more storage area devices for storing instructions and data. Generally, a computer will also include, or be operatively coupled to receive data from, or transfer data to, or both, one or more machine-readable storage media, such as mass storage devices for storing data, such as magnetic, magneto-optical disks, or optical disks. Non-transitory machine-readable storage media suitable for embodying computer program instructions and data include all forms of non-volatile storage area, including by way of example, semiconductor storage area devices, such as EPROM (erasable programmable read-only memory), EEPROM (electrically erasable programmable read-only memory), and flash storage area devices; magnetic disks, such as internal hard disks or removable disks; magneto-optical disks; and CD-ROM (compact disc read-only memory) and DVD-ROM (digital versatile disc read-only memory).

Elements of different implementations described may be combined to form other implementations not specifically set forth previously. Elements may be left out of the systems described without adversely affecting their operation or the operation of the system in general. Furthermore, various separate elements may be combined into one or more individual elements to perform the functions described in this specification.

Other implementations not specifically described in this specification are also within the scope of the following claims.

What is claimed:

1. A laser tool configured to operate within a wellbore, the laser tool comprising:

an integrator configured to receive a laser beam from a laser head and to combine the laser beam and a purging medium; and a conduit to generate a laminar flow from the purging medium and to produce an output comprised of the laminar flow and the laser beam, the output being directed towards a target within the wellbore;

where at least part of the laser tool is configured for rotation to cause the output to rotate during application to the target, wherein the conduit comprises a diameter within a range from 0.25 inches to 2.0 inches, where the conduit comprises a length in a range from 6 inches to 40 inches, and where the conduit comprises a constant diameter throughout its length.

2. The laser tool of claim 1, where the conduit is attached to the laser head, and where the laser head is rotatable to cause the conduit to rotate, where the conduit comprises a tubular shape.

3. The laser tool of claim 2, where rotation of the conduit produces a pattern of impact on the target that is a spiral in shape.

4. The laser tool of claim 3, where the laser tool is configured for rotation to produce the pattern of impact by starting at a point and spiraling outward.

5. The laser tool of claim 3, where the laser tool is configured for rotation to produce the pattern of impact by starting at a point and spiraling inward.

6. The laser tool of claim 1, where the purging medium comprises a gas.

7. The laser tool of claim 1, where the purging medium comprises halocarbon.

8. The laser tool of claim 1, where the purging medium comprises liquid.

9. The laser tool of claim 1, where the integrator is configured to produce a turbulent flow of the purging medium;

where the conduit is configured to convert the turbulent flow to the laminar flow, the laminar flow surrounding the laser beam, and where the laser beam comprises a diameter in a range from 0.25 inches to 2.0 inches.

10. The laser tool of claim 9, where an optical power of the laser beam is within a range of 0.2 kilowatts (kW) to 100 kW, where the conduit comprises a tubular shape, and where the tubular shape of the conduit and the length of the conduit causes the turbulent flow to change to the laminar flow.

11. The laser tool of claim 1, where an optical power of the laser beam is below 1.0 kilowatts (kW).

12. The laser tool of claim 1, further comprising:

a connector to connect the laser tool to a coiled tubing string, the coiled tubing string for moving the laser tool through the wellbore and within a hole created in a formation through which the wellbore extends, the coiled tubing string being configured to move the laser tool along a longitudinal axis.

13. The laser tool of claim 1, further comprising:

an acoustic sensor on the conduit to capture sound during operation of the laser tool.

14. A method of operating a laser tool, comprising:

combining a laser beam and a purging medium in a turbulent flow;

generating a laminar flow from the turbulent flow, the laser beam being contained within the laminar flow; and rotating the laser tool while outputting the laser beam and the laminar flow from the laser tool towards a target within a wellbore, where the purging medium comprises air, where 5 kW/cm^2 is within an operational intensity range of the laser tool, where generating a laminar flow comprises generating a laminar flow in a conduit, the conduit comprising a tubular shape and a constant diameter throughout its length, and where the tubular shape of the conduit and the length of the conduit cause the turbulent flow to change to the laminar flow.

15. The method of claim 14, where rotating the laser beam comprises:

initially rotating the laser tool; and increasing a diameter of rotation for subsequent rotations of the laser tool until a hole is formed through at least part of the target, where the laser tool operates within a first power range when the target comprises more than 55% quartz, where the laser tool operates within a second power range when the target comprises calcium carbonate, and where the second power range is higher than the first power range.

16. The method of claim 15, further comprising:

after the hole is formed, moving the laser tool towards or into the hole; and rotating the laser tool following moving such that the laser beam and the laminar flow from the laser tool are output towards the hole, where rotating the laser tool following moving comprises:

initially rotating the laser tool; and decreasing a diameter of rotation for subsequent rotations of the laser tool until the hole is extended through the at least part of the target, where the first power range comprises an optical power range from 800 W to 1,200 W, and where 5,000 W is within the second power range.

17. The method of claim 16, further comprising:

after the hole is extended, moving the laser tool towards or into the hole; and rotating the laser tool following moving the laser tool towards or into the hole such that the laser beam and the laminar flow from the laser tool are output towards the hole, where rotating the laser tool following moving the laser tool into the hole comprises:

initially rotating the laser tool; and increasing a diameter of rotation for subsequent rotations of the laser tool until the hole is further extended through the at least part of the target, where the laser tool comprises a direct diode laser.

18. The method of claim 16, where moving the laser tool towards or into the hole is performed using a coiled tubing string, and where the laser tool comprises at least one of an ytterbium laser, an erbium laser, and a neodymium laser.

19. The method of claim 14, where rotation of the laser tool produces a pattern of impact on the target that is a spiral in shape, and where the laser tool comprises at least one of a dysprosium laser, a praseodymium laser, and a thulium laser.

20. The method of claim 14, where a combination of the purging medium and rotating the laser tool causes debris to be expelled from the target away from a path of the laser beam.

* * * * *